United States Patent [19]

Booth

[11] Patent Number: 4,519,498

[45] Date of Patent: May 28, 1985

[54] SECURING MECHANISM FOR CONTAINER COMPONENTS AND THE LIKE

[76] Inventor: Darcy L. Booth, 11750 E. Ranchito St., El Monte, Calif. 91732

[21] Appl. No.: 588,938

[22] Filed: Mar. 13, 1984

[51] Int. Cl.[3] ..... B65D 85/28; B65D 25/10

[52] U.S. Cl. ..... 206/214; 206/45.16; 206/507; 206/804; 211/69; 220/8

[58] Field of Search ..... 206/214, 45.16, 804, 206/507, 45.19; 211/69; 220/8, 93

[56] References Cited

U.S. PATENT DOCUMENTS

| | | | |
|---|---|---|---|
| 750,632 | 1/1904 | Fisher | 220/8 |
| 1,296,742 | 3/1919 | Bevington | 220/8 |
| 1,566,860 | 12/1925 | Hainzigianis | 206/362.1 |
| 4,109,789 | 8/1978 | Fattori et al. | 206/404 |
| 4,136,773 | 1/1979 | Booth | 206/214 |

*Primary Examiner*—William T. Dixson, Jr.
*Attorney, Agent, or Firm*—Boniard I. Brown

[57] ABSTRACT

A securing mechanism for releasible securement together of components and a latch member having at least one projection transverse of its axis, biasing means mounting the latch member on the first component for limited angular movement about its axis and biasing the latch member to a first angular position, a second component defining a bore to receive the latch member and defining one or more grooves extending along the bore to receive the projection to allow axial movement between the first and second components when the projection is in registration with the groove, and means defining a ledge adjacent the bore to receive the latch member to prevent relative axial movement between the components with the latch member in its first angular position. Manual movement of the latch member between its angular positions allows relative movement between components for separation. A second ledge may be spaced from the other ledge to prevent relative axial movement between components when the latch member is in its second axial position. The second component may be a box having side walls and the first component may be a removable holding tray fitting within the side walls adapted to receive a plurality of articles.

21 Claims, 15 Drawing Figures

SECURING MECHANISM FOR CONTAINER COMPONENTS AND THE LIKE

BACKGROUND OF THE INVENTION

The present invention relates in part to improvements on the invention disclosed and claimed in U.S. Pat. No. 4,136,773, to Darcy L. Booth, issued on Jan. 30, 1979.

There has existed existed a need for a securing arrangement or mechanism for the releasible securement of components by securing mechanisms involving only members or elements integral with or on the components to be secured, without requiring separate fasteners, components or any steps or procedures other than simple manipulation. It is desirable that such securing mechanisms be readily and economically manufactured, and that they be economically fabricated integrally with the components to be secured. Desirably, such a securing mechanism can be quickly and conveniently manually adjusted to provide selected relative positions of the components.

Such securing mechanisms have been particularly needed for containers of pluralities of small articles, such as crayons and the like.

Although the particular embodiment of the securing mechanism of the invention herein illustrated and described relates to such a container for crayons and the like, it will be understood that the invention has applications with various components for providing a securing or latching mechanism which may be manually operable to releasibly secure the components together.

Containers of the prior art for containing such articles have been characterized by various shortcomings such that they do not satisfactorily meet adequately the requirements for use for such articles as the crayons used by artists, children and other users. Prior art containers have ordinarily been cardboard or plastic boxes or cartons in which the crayons or like articles are sold and provided, with the exception of the apparatus of the above-mentioned U.S. Pat. No. 4,136,773. Such containers fail to protect crayons from breakage and mutual abrasion and smudging.

For use by artists or children, a considerable number of individual crayons are utilized, and should or must be available because of the need for a variety of colors and hues. Devices and containers of the prior art have not generally or only rarely provided any convenient and ready accessibility of respective crayons of respective colors. Generally, it is necessary for the artist, child, etc. to manually sort at random through a disorganized collection of crayons for a selected color, with significant inconvenience, time consumption and frustration.

It is therefore a purpose and object of the invention to provide a securing mechanism for the detachable securement of two components in selected relative positions, quickly and conveniently by quick, simple manual manipulation.

An object of the invention is to provide such a securing mechanism for the detachable securement of a holder tray for small articles in a selected position in a container or box, so that articles of varying lengths may be accommodated.

It is an object of the invention to provide such a securing mechanism, the members of which may be integrally formed with the components to be secured.

An object of the invention is the provision of such a securing mechanism which is adapted for economical fabrication by injection molding.

An object of the invention is the provision of a container for small articles, such as crayons, wherein the articles are stored in an organized manner in respective storage positions for ready accessibility and selection.

SUMMARY OF THE INVENTION

The aforementioned objects and advantages, together with other advantages which will become apparent from the description and drawings, are attained in a securing or latching mechanism for releasibly securing the two components together, which includes a latch member, biasing means mounting the latch member on a first component for limited angular movement about its axis and interconnecting the second component and the latch member to bias the latch member into a first angular position. The latch member has at least one transverse projection extending therefrom. A bore is defined on a second component to receive the latch member and at least one groove extends along the bore and is adapted to receive the latch member projection for relative axial movement between the components with the latch member in its second angular position in registration with the groove. A ledge is defined adjacent the bore to receive the projection to prevent relative axial movement between the components with the latch member in its first angular position. A second ledge may be provided to prevent relative axial movement between the components when the latch member is in a second axial position relative to the bore.

The components are thus secured together when the latch member is in its first position which is biased by the biasing means which may preferably be a spring formed integrally with the first component and the latch member. Manual movement of the latch member from its first to its second angular position permits relative movement between the latch member and the second component for separation of the components.

The components may thus be quickly and conveniently separated by simple, quick manual manipulation of the latch member or members. In the container for small articles, such as crayons, embodying the securing mechanism, the accessibility and selection of respective crayons is greatly facilitated, simplified and routine. Random searching and finding in a disorganized array of crayons, is eliminated. The articles are maintained in an organized manner with individual positions for quick, convenient selection. The spillage of such articles is essentially eliminated by the provision of frictional retaining elements which retain the articles in position upon the tipping or overturning of the container.

DESCRIPTION OF THE PREFERRED EMBODIMENT

Figure 1:
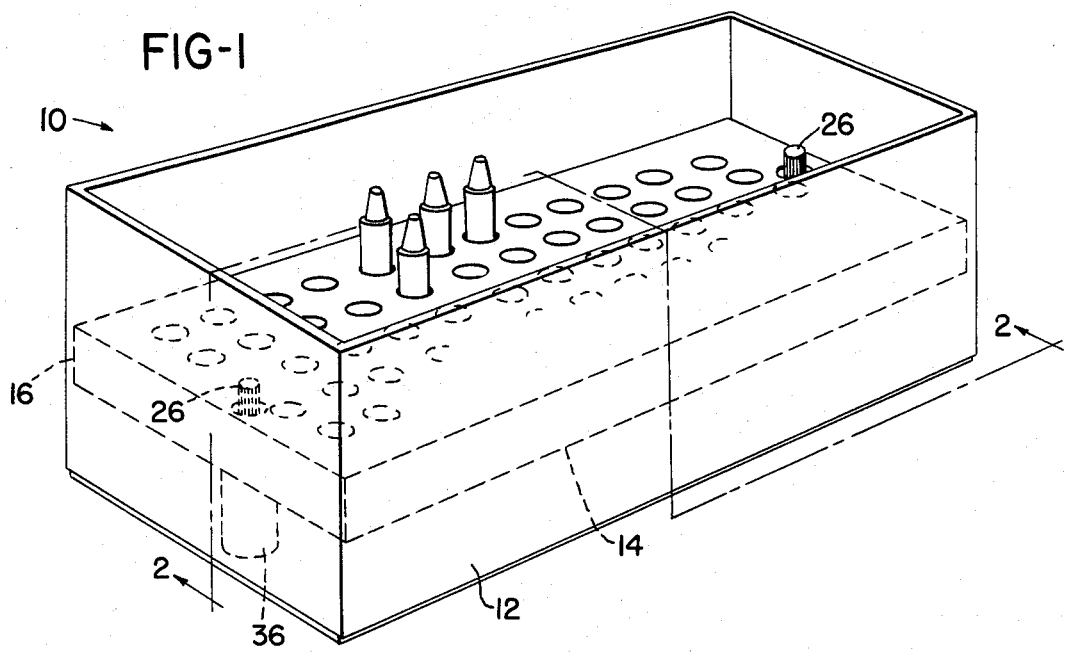
FIG. 1 is a perspective view of a crayon storage container utilizing a securing mechanism according to the invention.
Figure 2:
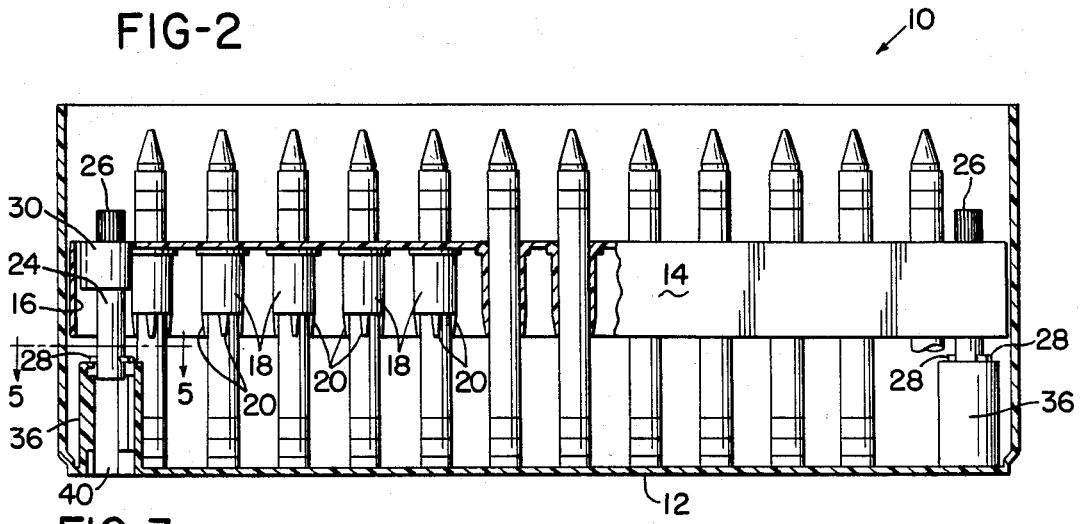
FIG. 2 is an elevational sectional view, partially broken away at line 2—2 in FIG. 1.

Referring to the drawings, FIGS. 1 and 2 show a crayon container 10 which includes an upwardly open box component 12 having a bottom wall and normally upwardly extending side walls. A tray or support member 14 is disposed in the box and has a peripheral depending flange 16 which slidably abuts the side walls of box 12. The support component or holding tray 14 is provided with a plurality of sleeves 18, each having a plurality of depending fingers 20 for frictional engagement with crayons to remain crayons in position and against falling out when the box is tipped or overturned.

The tray or support component 14 has molded or formed integrally therewith two elongated generally cylindrical latching members 24. Each cylindrical latch member 24 has thereon a knurled knob 26 and radial oppositely extending projections or wings 28.

Figure 4:
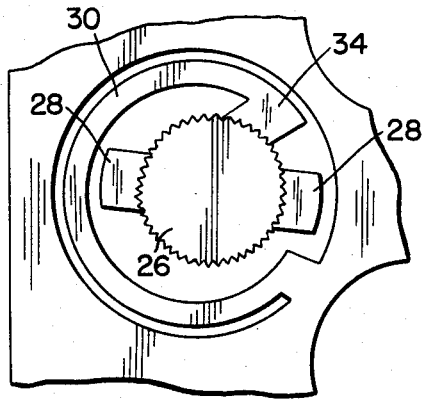
FIG. 4 is an enlarged fragmentary plan view of a portion of the securing mechanism of the invention in one angular position of its latch member.
Figure 4A:
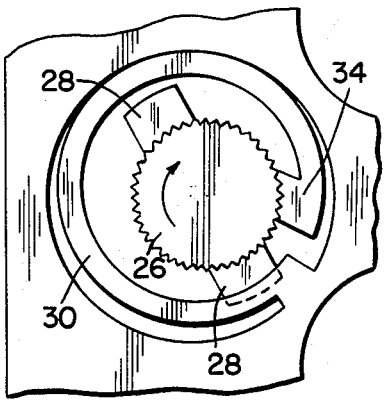
FIG. 4A is an enlarged view similar to that of FIG. 4, showing the securing mechanism latch member in a second angular position.

Biasing springs 30 are integrally molded with the tray 14 and the latch member 24. Each spring 30 extends from its base portion 32 on tray 14 arcuately approximately 270° to its connection at 34 with a latch member 24, as shown in FIGS. 4 and 4A. Each spring 30 biases a cylindircal latch member 24 to a first angular position, shown in FIG. 4. Manual rotational force exerted on the knurled knob 26 rotates a latch member 24 to its second angular position shown in FIG. 4A, against the urging of the spring.

Figure 3:
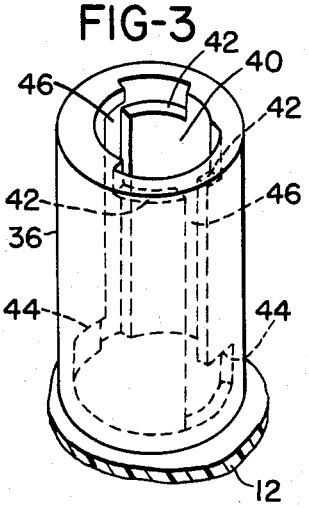
FIG. 3 is an enlarged perspective partial view of a portion of the storage container of FIGS. 1 and 2.

Extending upwardly from the bottom wall of box 12 at both end portions thereof are integrally formed cylindrical portions 36. Each cylindrical portion 36 defines an elongated opening or bore 40 and adjacent upper and lower ledges or stops 42, 44, as best shown in FIG. 3. Elongated channels or grooves 46 are defined 180° apart in each cylindrical portion 36 adjacent to and in communication with the bore, as shown, these grooves being adapted slidably to receive the wings or projections 28 of latch member 24.

FIGS. 5 through 14 illustrate the manner of operation and cooperation of the components and features described above in the securement of the tray or support component 14 in its first and second elevational positions relative to box 12.

Figure 5:
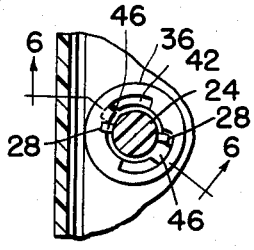
FIG. 5 is a partial sectional plan view, taken at line 5—5 in FIG. 2.
Figure 6:
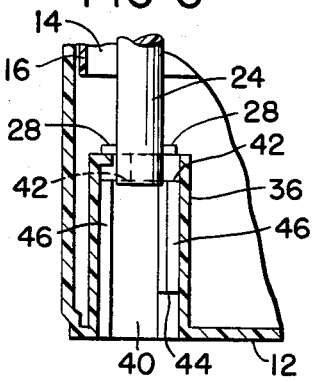
FIG. 6 is a sectional view taken at line 6—6 in FIG. 5.

FIGS. 5 and 6 illustrate the positional relationship of the latch member of the lockng mechanism with the tray or support component 14 in its upper position, wherein the projections 28 of latch member 24 rest atop cylindrical portion 36, the projections 28 bring out of registration with grooves 46.

Figure 7:
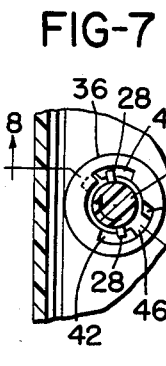
FIG. 7 is a view similar to that of FIG. 5, showing a latch member of the securing mechanism in a different angular position.
Figure 8:
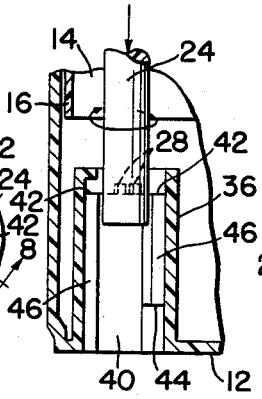
FIG. 8 is a view similar to that of FIG. 6, showing a latch member of the securing mechanism in a different angular position.
Figure 9:
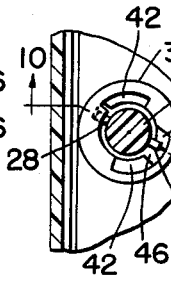
FIG. 9 is a view similar to that of FIG. 5, showing the securing mechanism components in different relative positions.
Figure 10:
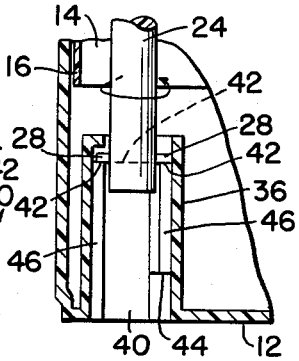
FIG. 10 is a sectional view taken at line 10—10 in FIG. 9.

FIGS. 7 and 8 show the latch member 24 after manual rotation clockwise, as viewed in FIG. 7, in the direction of the circular arrow in FIG. 8, with the latch member urged downwardly. FIGS. 9 and 10 i11ustrate the position of latch member 24 after release of its knurled portion 26 and its returned position of FIG. 4 by rotation in the direction of the circular arrow in FIG. 10 under the action or bias of integral spring 30, with projections 28 seated atop upper ledges 42.

Figure 11:
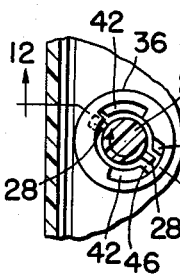
FIG. 11 is a view similar to that of FIGS. 5 and 6, showing securing mechanism components in different relative angular positions.
Figure 12:
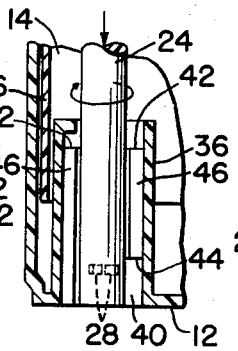
FIG. 12 is a sectional view taken at line 12—12 in FIG. 11.

FIGS. 11 and 12 illustrate the relative positions of the securing mechanism components after manual twisting of latch member 28 in the clockwise direction as viewed in FIG. 11, and in the direction of the circular arrow in FIG. 12, by means of knurled knob 26 againt the bias of spring 30 to a position wherein projections 28 register with the grooves 46, the latch member 24 being urged downwardly.

Figure 13:
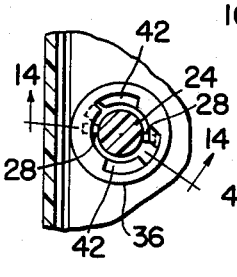
FIG. 13 is a view similar to that of FIG. 5, showing the latch member mechanism in a different position of operation.
Figure 14:
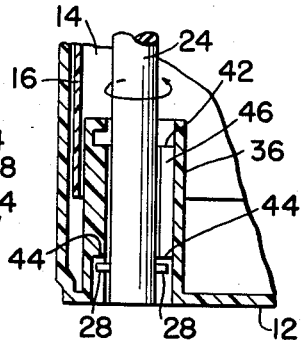
FIG. 14 is a sectional view taken at line 14—14 in FIG. 13.

FIGS. 13 and 14 illustrate the relationship of the components after manual release of latch member 24 and its rotation in the direction of the circular arrow in FIG. 14 to the position generally indicated in FIG. 4, with its projections 28 seated or resting on the lower ledges 44, so that the tray or support component 14 is supported in its lowermost position.

As crayons wear and become shorter after usage, the tray 14 may be elevated to its successive upper positions, utilizing the securing mechanism in the manner described and shown, to accommodate and make accessible the shorter crayons.

Substantial economy of fabrication is effected by the simultaneous molding of cylindrical portions 36 and its features integrally with the box, and by the molding of the latch members 24, their features and integral springs 30 integrally with the tray or support component 14.

Therefore there has been shown and described a novel securing mechanism for container components which fulfills all of the objects and advantages sought therefor. Many changes, modifications, variations and other uses and applications of the subject invention will, however, become apparent to those skilled in the art after considering the foregoing specification together with the accompanying drawings. All such changes, modifications, variations and other uses and applications which do not depart from the spirit and scope of the invention are deemed to be covered by the invention which is limited only by the claims which follow.

The inventor claims:

1. A securing mechanism for the releasible securement together of first and second components, comprising:

an elongated latch member having a longitudinial axis, biasing means mounting the latch member on the first component for limited angular movement about its said axis between first and second angular positions of the latch member, said biasing means interconnecting the second component and the latch member, and said biasing means biasing the latch member to said first angular position, at least one projection on the latch member extending transversely of said latch member axis, means on the second component defining a bore adapted to receive the latch member, means defining at least one groove communicating with and extending along said bore and adapted to receive said latch member projection to allow relative axial movement between the first and second components when the latch member is in its second angular position wherein said projection is in registration with said groove, and means defining a first ledge adjacent to and extending radially of said bore and adjacent to and generally perpendicular to said groove for receiving the latch member projection to prevent relative axial movement between the first and second components when the latch member is in its first angular position and in a first axial position relative to said bore, whereby the first and second components are secured together when the latch member is in its said first position, and manual movement of the latch member from its said first to its said second angular position allows relative movement between the latch member and said bore for separation of the first and second components.

2. A securing mechanism according to claim 1, and further including:

means defining a second ledge adjacent to and extending radially of said bore, said second ledge being spaced from said first ledge to prevent relative axial movement between the first and second components when the latch member is in a second axial position relative to said bore.

3. A securing mechanism according to claim 1, wherein:

said biasing means comprises a spring element formed integrally with the latch member and connected with the first component.

4. A securing mechanism according to claim 2, wherein:

said biasing means comprises a spring element formed integrally with the latch member and connected with the first component.

5. A securing mechanism according to claim 1, wherein:

said biasing means comprises a spring element, and said latch member and the spring element are formed integrally with the first component.

6. A securing mechanism according to claim 2, wherein:

said biasing means comprises a spring element, and said latch member and the spring element are formed integrally with the first component.

7. A securing mechanism according to claim 1, wherein:

said first component, the latch member and said biasing means are integrally formed of plastic material by injection molding.

8. A securing mechanism according to claim 2, wherein:

said first component, the latch member and said biasing means are integrally formed of plastic material by injection molding.

9. A securing mechanism according to claim 3, wherein:

said biasing means comprises an arcuate spring element formed integrally with the latch member and the first component, and said arcuate spring extends at least 180° from its integral connection to a wall of said bore to its integral connection with said latch member.

10. A securing mechanism according to claim 4, wherein:

said biasing means comprises an arcuate spring element formed integrally with the latch member and the first component, and said arcuate spring extends at least 180° from its integral connection to a wall of said bore to its integral connection with said latch member.

11. A securing mechanism according to claim 5, wherein:

said latch member is of elongated cylindrical configuration.

12. A container and organizer for crayons and the like, comprising:

a box having a bottom wall and normally upwardly extending side walls, a removable tray configurated and sized to fit within said side walls and defining a plurality of orifices sized to receive said crayons, a securing mechanism for the releasible securement of said tray at different positions relative to said side walls of the box with the crayons extending downwardly supported by the bottom wall and extending upwardly above the said holder tray, an elongated latch member having a longitudinal axis, biasing means mounting the latch member on the holder tray for limited angular movement about its said axis between first and second angular positions of the latch member, said biasing means interconnecting the box and the latch member, and said biasing means biasing the latch member to said first angular position, at least one projection on the latch member extending transversely of said latch member axis, means defining at least one groove communicating with and extending along said bore and adapted to receive said latch member projection to allow relative axial movement between the holder tray and the box when the latch member is in its second angular position wherein said projection is in registration with said groove, and means defining a first ledge adjacent to and extending radially of said bore and adjacent to and generally perpendicular to said groove for receiving the latch member projection to prevent relative axial movement between the holder tray and the box when the latch member is in its first angular positions and in a first axial position relative to said bore, whereby the holder tray and the box are secured together when the latch member is in its said first position, and manual movement of the latch member from its said first to its said second angular position allows relative movement between the latch member and said bore for separation of the holder tray and the box.

13. A securing mechanism according to claim 12, and further including:

means defining a second ledge adjacent to and extending radially of said bore, said second ledge being spaced from said first ledge to prevent relative axial movement between the holder tray and the box when the latch member is in a second axial position relative to said bore.

14. A securing mechanism according to claim 12, wherein:

said biasing means comprises a spring element formed integrally with the latch member and connected with the holder tray.

15. A securing mechanism according to claim 13, wherein:

said biasing means comprises a spring element formed integrally with the latch member and connected with the holder tray.

16. A securing mechanism according to claim 12, wherein:

said biasing means comprises a spring element, and said latch member and the spring element are formed integrally with the holder tray.

17. A securing mechanism according to claim 12, wherein:

said holder tray, the latch and said biasing means are integrally formed of plastic material by injection molding.

18. A securing mechanism according to claim 12, wherein:

said biasing means comprises an arcuate spring element formed integrally with the latch member and the holder tray, and said arcuate spring extends at least 180° from its integral connection to a wall of said bore to its integral connection with said latch member.

19. A securing mechanism according to claim 16, wherein:

said latch member is of elongated cylindrical configuration.

20. A securing mechanism according to claim 12, and further including:

a plurality of fingers extending from said tray adjacent each of said orifices for frictional retaining engagement with said crayons to retain the crayons in their positions and against falling from the tray when the box is tipped or overturned.

21. A securing mechanism according to claim 16, and further including:

a plurality of fingers extending from said tray adjacent each of said orifices for frictional retaining engagement with said crayons to retain the crayons in their positions and against falling from the tray when the box is tipped or overturned.

* * * * *